US009078067B2

(12) United States Patent
Dallas et al.

(10) Patent No.: US 9,078,067 B2
(45) Date of Patent: Jul. 7, 2015

(54) SOUNDER ASSEMBLY FOR EXPLOSIVE ENVIRONMENT

(71) Applicant: Piezotech, LLC, Indianapolis, IN (US)

(72) Inventors: James Michael Dallas, Superior, CO (US); Frans Lautzenhiser, Zionsville, IN (US)

(73) Assignee: Piezotech, LLC, Indianapolis, IN (US)

( * ) Notice: Subject to any disclaimer, the term of this patent is extended or adjusted under 35 U.S.C. 154(b) by 0 days.

(21) Appl. No.: 14/208,777

(22) Filed: Mar. 13, 2014

(65) Prior Publication Data

US 2014/0270277 A1 Sep. 18, 2014

Related U.S. Application Data

(60) Provisional application No. 61/787,091, filed on Mar. 15, 2013.

(51) Int. Cl.

| | |
|---|---|
| ***H04R 5/00*** | (2006.01) |
| ***H04R 17/00*** | (2006.01) |
| *H04R 1/28* | (2006.01) |

(52) U.S. Cl.

CPC ..... *H04R 17/00* (2013.01); *H04R 1/2842* (2013.01)

(58) Field of Classification Search

CPC ..... G10K 9/00; G10K 9/122
USPC ..... 381/189, 190, 191, 332, 334, 335, 386, 381/387, 388; 340/384.6
See application file for complete search history.

(56) References Cited

U.S. PATENT DOCUMENTS

| | | | | |
|---|---|---|---|---|
| 6,276,212 | B1 * | 8/2001 | Cooper et al. | 73/632 |
| 6,463,157 | B1 * | 10/2002 | May | 381/151 |
| 8,229,142 | B2 | 7/2012 | Colaizzi et al. | |
| 2004/0112672 | A1 * | 6/2004 | Ono et al. | 181/169 |
| 2007/0247028 | A1 | 10/2007 | Brosch et al. | |
| 2008/0212807 | A1 * | 9/2008 | Wang | 381/190 |
| 2008/0303644 | A1 * | 12/2008 | Landis | 340/384.6 |
| 2013/0076511 | A1 * | 3/2013 | Blanc et al. | 340/540 |

* cited by examiner

*Primary Examiner* — Curtis Kuntz
*Assistant Examiner* — Julie X Dang
(74) *Attorney, Agent, or Firm* — Woodard, Emhardt, Moriarty, McNett & Henry LLP

(57) ABSTRACT

An insulated sounder assembly may include: a) a sounder cup having a bottom and a sidewall; b) a piezoelectric element positioned in the bottom of the cup; c) a potting layer within the sounder cup and spaced apart from the piezoelectric element so that the potting layer contacts the cup sidewall for a distance of at least 3 mm around the entire circumference of the cup, and so that a gap exists between the piezoelectric element and the potting layer, with the gap being sufficient to allow vibration of the piezoelectric element in the sounder cup without restriction by the potting layer; and d) an electrical contact wire attached to the piezoelectric element to provide a voltage to the piezoelectric element, wherein the electrical contact wire passes through the potting layer so that at least 3 mm of bare wire is completely embedded in said potting layer.

14 Claims, 2 Drawing Sheets

SOUNDER ASSEMBLY FOR EXPLOSIVE ENVIRONMENT

REFERENCE TO RELATED APPLICATIONS

This application claims the benefit of U.S. Provisional Patent Application No. 61/787,091, filed Mar. 15, 2013, which is hereby incorporated by reference in its entirety.

BACKGROUND TO THE INVENTION

Piezoelectric sounders are used in personal alert safety systems such as on fire fighter gear. Such sounders may be used in explosive environments, so it is important to separate the high voltage of the sounder electronics from that environment.

Prior art sounders have attempted to solve the problem by increasing the thickness of the potting material that seals the sounder electronics from the environment. However, as potting material thickness increases, sounder performance diminishes if the piezoelectric material cannot vibrate effectively.

A need therefore exists for a sounder assembly that more effectively separates the high voltage of the sounder electronics from the potentially explosive environment. The present invention addresses that need.

SUMMARY OF THE INVENTION

According to one embodiment of the present invention there is provided a sounder assembly comprising:

a) a sounder cup having a bottom and a sidewall;

b) a piezoelectric element in the sounder cup and positioned on the bottom of the cup;

c) a potting layer within the sounder cup and spaced apart from the piezoelectric element so that a gap exists between the piezoelectric element and the potting layer, with the gap being sufficient to allow vibration of the piezoelectric element in the sounder cup without restriction by the potting layer.

The potting layer preferably contacts the cup sidewall for a distance of at least 3 mm around the entire circumference of the cup to isolate the piezo element from the environment outside the cup. An electrical contact wire is attached to the piezoelectric element to provide a voltage to the piezoelectric element. The electrical contact wire passes through the potting layer so that at least 3 mm of bare wire is completely embedded in said potting layer.

In another embodiment there is provided an assembly comprising a sounder in a housing. The sounder portion of the assembly may be as described above. The housing protects the sounder from damage when used in a hostile environment such as in a personal alert safety systems such as on fire fighter gear.

The sounder assembly may be provided in the housing in a manner in which the top and/or bottom surfaces of the sounder are substantially free from compressive forces. Most preferably, the sounder may be held in the housing by lateral forces that push inward against the sidewall of the sounder assembly cup. In some embodiments the sounder assembly is held in the housing by lateral forces provided by an O-ring that pushes inward against the sidewall of the sounder assembly cup.

In the most preferred embodiments the housing includes a Helmholtz resonator portion.

DESCRIPTION OF PREFERRED EMBODIMENTS

Figure 1:
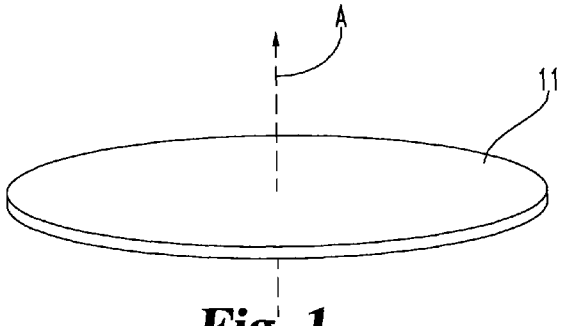
FIG. 1 shows a piezoelectric element as used in one embodiment of the sounder assembly of the present invention.

For the purposes of promoting an understanding of the principles of the invention, reference will now be made to certain preferred embodiments and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As indicated above, one embodiment of the present invention provides a sounder assembly. The preferred sounder assembly comprises:

a) a sounder cup having a bottom and a sidewall;

b) a piezoelectric element within the sounder cup and bonded to the bottom of the cup;

c) a potting layer within the sounder cup and above and spaced apart from the piezoelectric element;

d) a gap between the piezoelectric element and the potting layer, with the gap being sufficient to allow vibration of the piezoelectric element without restriction by the potting layer.

The sounder cup is preferably made of a thin, metal material such as steel or titanium. The cup is preferably generally cylindrical in shape, with a closed bottom end.

The sounder assembly cup may include a shoulder on the sidewall to provide a structure to hold a support member. The shoulder is preferably positioned at a height effective to support the support member at the appropriate height effective to allow the piezoelectric element to vibrate without restriction by the potting layer when the potting layer is supported on the shoulder.

The piezoelectric element is preferably positioned on the inner surface of the sounder assembly cup, and is preferably bonded to that surface with a high-temperature epoxy. When so bonded, vibration of the piezo element causes the cup bottom to vibrate, thus producing sound waves by vibration of the cup bottom.

The top side of the piezoelectric element is preferably free from a structure that would restrict vibration, and in particular is substantially free from compressive forces. The top surface of said piezoelectric element may be provided with an electrical contact wire to provide a voltage to the piezoelectric element.

A potting layer seals and/or insulated the piezoelectric element in the cup in a manner in which the piezoelectric element is isolated from the environment. Such isolation may be ensured by having the potting layer contact the inside of the cup wall for a distance of at least 3 mm all around the circumference of the cup. In addition, isolation may be ensured by having the electrical contact wire pass through the potting layer, with at least 3 mm of bare wire being completely embedded in the potting layer.

The potting layer is preferably held above the piezoelectric element by a support. The support layer may be made of a high-temperature thermoplastic, such as polyether ether ketone (PEEK). The support preferably has the same outer shape and size as the inner wall of the sounder cup to allow the entire area below the support to be sealed from the environment by the potting layer.

The support preferably rests on a shoulder positioned in the cup at a height effective to allow the piezoelectric element to vibrate without restriction by the potting layer when the potting layer is supported on the shoulder. This provides a gap between the potting layer and the piezoelectric element, with the gap being wide enough to ensure that the potting layer does not interfere with the vibration of the piezoelectric.

The gap height is preferably between about 0.5 mm and 5.0 mm, and more preferably between about 0.5 mm and 3.0 mm. Most preferably the gap height is about 1.0 mm to 2.0 mm.

In another embodiment there is provided a sounder contained within a housing. The sounder portion of the assembly may be as described above. The housing portion of the assembly protects the sounder from damage when used in a hostile environment such as in a personal alert safety systems such as on fire fighter gear. In the most preferred embodiments the housing includes a Helmholtz resonator portion.

The sounder may be held in the housing by lateral forces that push inward against the sidewall of the sounder assembly cup. In some embodiments the sounder assembly is held in the housing by lateral forces provided by an O-ring that pushes inward against the sidewall of the sounder assembly cup. The top surface and/or bottom surfaces of the sounder assembly may be held in the housing in a manner that is substantially free from compressive forces against the top of the sounder assembly.

Referring now to the drawings, FIG. 1 shows piezoelectric element 11 having a top surface and a bottom surface and defining a central axis "A" of vibration. Piezoelectric element 11 is preferably disc-shaped, with a thickness of about 0.2 mm. The disc may have a diameter of about 20 mm.

Figure 2:
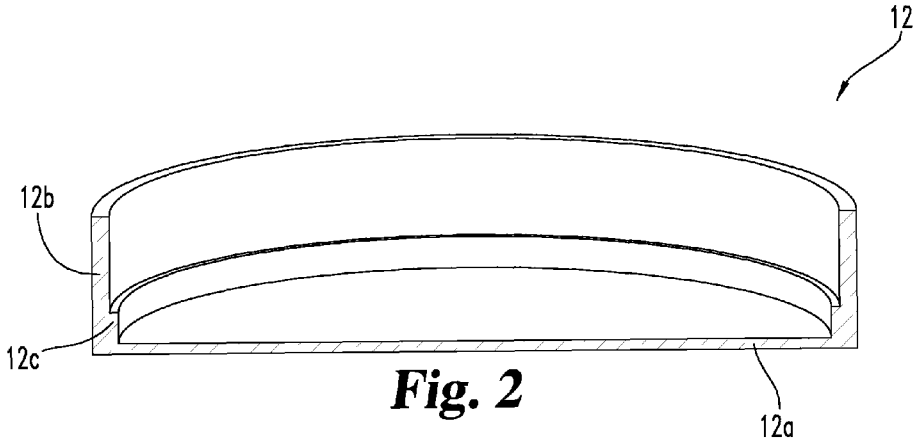
FIG. 2 shows a sounder assembly cup as used in one embodiment of the present invention.

FIG. 2 shows a sounder assembly cup 12 having an end 12*a* and a sidewall 12*b*. End 12*a* has an inner surface and an outer surface, and sidewall 12*b* has a length of at least 3 mm extending upward from end 12*a*. A shoulder 12*c* is provided in the cup at a height effective to allow the piezoelectric element to vibrate below the shoulder without restriction by a potting layer when the potting layer is supported on the shoulder.

Figure 3:
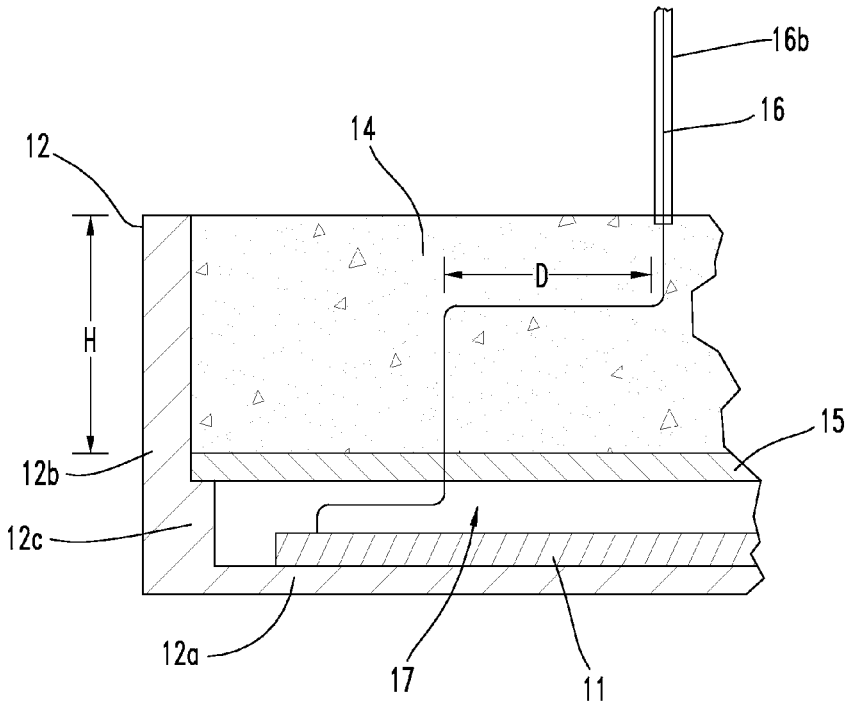
FIG. 3 shows a partial section view of the sounder assembly.

FIG. 3 shows a partial elevational view of sounder assembly 10 in section. Piezoelectric element 11 is bonded to the inner surface of cup end 12*a* so that approximately 75% to 85%, and most preferably about 80%, of the cup end is covered by the piezoelectric element.

A support 15 is provided on shoulder 12*c* and defines a gap 17 below the shoulder. Support 15 may be made of any high-temperature material effective to support potting layer 14. In the most preferred embodiment the support is made of polyether ether ketone (PEEK). Gap 17 has a height that allows piezo element 11 to vibrate to vibrate in the cup without interference from the 3 mm thick potting layer. In some preferred embodiments the gap height is between 0.5 mm and 5.0 mm, and more preferably between 0.5 mm and 3.0 mm. In other embodiments the gap height is about 1.0 mm to 2.0 mm.

A potting layer 14 rests on support layer 15 and seals piezoelectric element 11 in cup 12 in a manner in which the piezoelectric element is isolated from the environment. Potting layer 14 contacts cup 12 along the periphery for a height "H" of at least 3 mm to ensure adequate sealing and isolation of the piezoelectric element.

Electrical contact wire 16 passes through potting layer 14, with a distance "D" of at least 3 mm of bare wire being completely embedded in the potting layer. The wire extending above the potting layer preferably is encased in an electrical insulation material.

Figure 4:
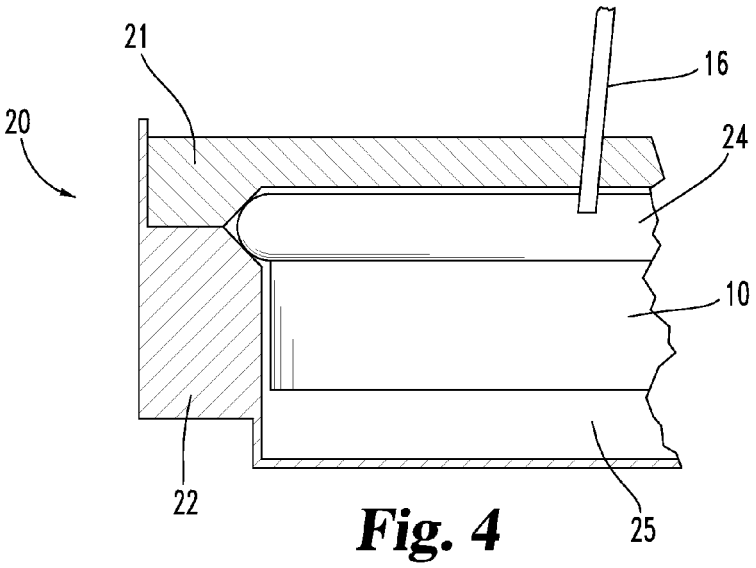
FIG. 4 shows the sounder assembly in a housing.

FIG. 4 shows sounder assembly 10 in a housing 20. Housing 20 includes a top portion 21 and a bottom portion 22. Each of top portion 21 and bottom portion 22 may include a bevel 23 to provide a space for contacting an O-ring 24 surrounding sounder assembly 10. Housing 20 pushes laterally against O-ring 24 to hold sounder assembly 10 in housing 20 without compression on the top or bottom surface of assembly 10. Top portion 21 and bottom portion 22 may be connected by a swaged connection between the two pieces.

It is to be appreciated that sounder assembly 10 is preferably contained in housing 20 in a manner in which there is no axial compression of the assembly in general, or of the piezoelectric element in particular. Assembly 10 may touch the housing, but the assembly is not held in place by axial compression of the assembly or the piezoelectric element in the housing.

Housing 20 may include a Helmholtz resonator portion 25.

Drain holes may be included in housing 20. The drain holes are preferably located below the top surface of assembly 10 to allow water to drain from the device without collecting on the top surface of assembly 10.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

Additionally, it is to be appreciated that the elements described herein may be combined in combinations and subcombinations other than those described as preferred embodiments. Moreover, the inventive devices may comprise any or all combinations of the disclosed elements, or the inventive devices may consist essentially of any or all combinations of the disclosed elements.

The invention claimed is:

1. A sounder assembly, comprising:

a) a sounder cup having a bottom and a sidewall;

b) a piezoelectric element within said sounder cup and positioned on the bottom of the cup;

c) a potting layer within the sounder cup and above and spaced apart from said piezoelectric element;

d) an open air gap between said piezoelectric element and said potting layer, wherein said gap is effective to allow vibration of the piezoelectric element without restriction in the direction of the potting layer, so that the piezoelectric element is free to vibrate in two directions toward the sounder cup and toward the potting layer.

2. The sounder assembly of claim 1 wherein the top surface of said piezoelectric element is provided with an electrical contact wire to provide a voltage to the piezoelectric element.

3. The sounder assembly of claim 2 wherein the electrical contact wire passes through said potting layer, with the wire have at least 3 mm of bare wire completely embedded in said potting layer.

4. The sounder assembly of claim 1 wherein said potting layer contacts said cup sidewall for a distance of at least 3 mm around the entire circumference of the cup.

5. The sounder assembly of claim 1 wherein said potting layer is a potting epoxy.

6. The sounder assembly of claim 1 wherein said potting layer is separated from said gap by a support member.

7. The sounder assembly of claim 6 wherein said support member is a PEEK layer.

8. The sounder assembly of claim 6 wherein the sounder cup includes a shoulder positioned at a height effective to support said support member at a height effective to allow the piezoelectric element to vibrate without restriction by the potting layer when the potting layer is supported on the shoulder.

9. The sounder assembly of claim 1 wherein said sounder assembly is contained in a housing.

10. The sounder assembly of claim 9 wherein said sounder assembly is held in said housing by lateral forces that push inward against the sidewall of the sounder assembly cup.

11. The sounder assembly of claim 10 wherein said lateral forces are provided by an O-ring that pushes inward against the sidewall of the sounder assembly cup.

12. The sounder assembly of claim 9 wherein the top surface of said sounder assembly is held in said housing in a manner that is substantially free from compressive forces against the top of the sounder assembly.

13. The sounder assembly of claim 9 wherein the bottom surface of said sounder assembly is held in said housing in a manner that is substantially free from compressive forces against the bottom of the sounder assembly.

14. The sounder assembly of claim 9 wherein the housing includes a Helmholtz resonator portion.

* * * * *